US010378311B2

(12) United States Patent
Bocangel Calderon et al.

(10) Patent No.: US 10,378,311 B2
(45) Date of Patent: Aug. 13, 2019

(54) HYDRAULICALLY OPENED AND BALL ON SEAT CLOSED SLIDING SLEEVE ASSEMBLY

(71) Applicant: Baker Hughes, a GE company, LLC, Houston, TX (US)

(72) Inventors: Wara Bocangel Calderon, Oklahoma City, OK (US); Robert S. O'Brien, Katy, TX (US); James S. Sanchez, Tomball, TX (US); James T. Nickles, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 155 days.

(21) Appl. No.: 15/652,437

(22) Filed: Jul. 18, 2017

(65) Prior Publication Data

US 2019/0024479 A1 Jan. 24, 2019

(51) Int. Cl.

| | |
|---|---|
| ***E21B 34/10*** | (2006.01) |
| ***E21B 34/06*** | (2006.01) |
| ***E21B 33/14*** | (2006.01) |
| ***E21B 23/04*** | (2006.01) |
| *E21B 34/00* | (2006.01) |

(52) U.S. Cl.

CPC ..... *E21B 34/10* (2013.01); *E21B 23/04* (2013.01); *E21B 33/146* (2013.01); *E21B 34/063* (2013.01); *E21B 2034/007* (2013.01)

(58) Field of Classification Search

CPC ..... E21B 34/10; E21B 34/063; E21B 33/146; E21B 2034/007

See application file for complete search history.

(56) References Cited

U.S. PATENT DOCUMENTS

| | | | |
|---|---|---|---|
| 6,543,538 | B2 | 4/2003 | Tolman et al. |
| 7,066,264 | B2 | 6/2006 | Bissonnette et al. |
| 8,157,012 | B2 | 4/2012 | Frazier |
| 2018/0245426 | A1* | 8/2018 | Strohla ..... E21B 23/006 |

* cited by examiner

*Primary Examiner* — Brad Harcourt
(74) *Attorney, Agent, or Firm* — Shawn Hunter

(57) ABSTRACT

Ported sub openings are controlled by a sliding sleeve assembly. In one variation an external sleeve is pressure actuated with internal pressure to open the ports. After the treatment the ports are closed with a ball landed on an internal sleeve seat and pressure applied from above. In a different arrangement a single internal sleeve is provided that is responsive to tubing pressure to open after breaking a retaining member. After the downhole procedure a ball is landed on a seat on the sleeve and pressure is applied to close the ports with the shifted sleeve and ball moving in tandem. Multiple sliding sleeves can be sequentially operated with sliding sleeves held by retainers that break at sequentially higher pressure moving in an uphole direction.

14 Claims, 2 Drawing Sheets

HYDRAULICALLY OPENED AND BALL ON SEAT CLOSED SLIDING SLEEVE ASSEMBLY

FIELD OF THE INVENTION

The field of the invention is ported subs for borehole use and more particularly where the port is opened and closed with at least one sliding sleeve pressure responsive for port opening and movable to a closed position with applied pressure to a seated ball on the sliding sleeve.

BACKGROUND OF THE INVENTION

Stage cementing is one application where valves are sequentially operated to open ports for the passage of cement into a surrounding annulus. After the cement is delivered the valves need to be closed. This not only increases the integrity of the well, but helps isolate certain zones of the completion allowing to operate other tools or to pressure test the string itself. Sliding sleeve valves have been used for this purpose in the past.

The shifting of the sliding sleeve from the open position to the closed position has been performed with a plug that latches into a profile in the sliding sleeve. A pressure application from above shifts the plug and sleeve in tandem to close the cementing ports at a given location. The problem with this design is that after the cementing application there may still be residual cement on the sleeve profile to the extent that the plug that had to enter the sleeve and latch with a collet type mechanism would not land properly. This prevents effective use of pressure above the landed plug to shift the sleeve shut isolating the ports.

What is needed and provided by the present invention is a better way to close the passage above the open port so that when pressure is applied the sliding sleeve shifts reliably to close the lateral port. The designs of the present invention can be a two sleeve design or a single sleeve design. In the two sleeve design an external sleeve is responsive to internal pressure to shift to open the ports for an operation such as cementing. After the cement passes through the open port a ball is landed on a seat integrated into the sliding sleeve and preferably located at the upper end of the sliding sleeve. Pressure is then applied to move the ball and sleeve in tandem to close the ports. Alternatively, a single internal sleeve constructed with differing end areas is subjected to internal pressure that results in a net force on the sleeve to slide it to a ports open position. After the cementing or other operation, a ball is landed on a seat preferably at the top of the sliding sleeve and pressure from above is applied so that the sleeve and the ball move in tandem to close the ports previously opened with internal pressure. If multiple sliding sleeves in multiple ported subs are used their movement can be staggered with breakable devices designed to release at different pressures. The sliding sleeves can be rotationally locked to expedite milling out the seats. The dropped balls can disintegrate after a time to avoid milling the balls out. The above described design is thought to more reliably obtain either a seal or to minimize leakage when pressure is applied sufficiently to generate the necessary closing force to the ball with no risk of the ball coming through the seat. Thus even with residual cement on the seat there is still a reliable way to close the port in a given ported sub. These and other aspects of the present invention will be more readily understood by those skilled in the art from a review of the detailed description of the preferred embodiment and the associated drawings while recognizing that the full scope of the invention is to be determined from the appended claims.

The following patents discuss sliding sleeve valves in general terms: U.S. Pat. Nos. 8,157,012; 6,543,538 and 7,066,264.

SUMMARY OF THE INVENTION

Ported sub openings are controlled by a sliding sleeve assembly. In one variation an external sleeve is pressure actuated with internal pressure to open the ports. After the treatment the ports are closed with a ball landed on an internal sleeve seat and pressure applied from above. In a different arrangement a single internal sleeve is provided that is responsive to tubing pressure to open after breaking a retaining member. After the downhole procedure a ball is landed on a seat on the sleeve and pressure is applied to close the ports with the shifted sleeve and ball moving in tandem. Multiple sliding sleeves can be sequentially operated with sliding sleeves held by retainers that break at sequentially higher pressure moving in an uphole direction.

DETAILED DESCRIPTION OF THE PREFERRED EMBODIMENT

Figure 1:
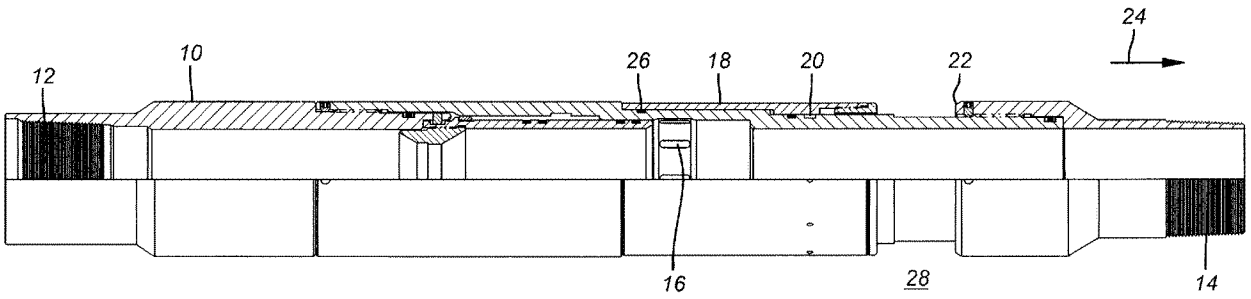
FIG. 1 is a section view of the two sliding sleeve assembly with the ports in the closed position.
Figure 2:
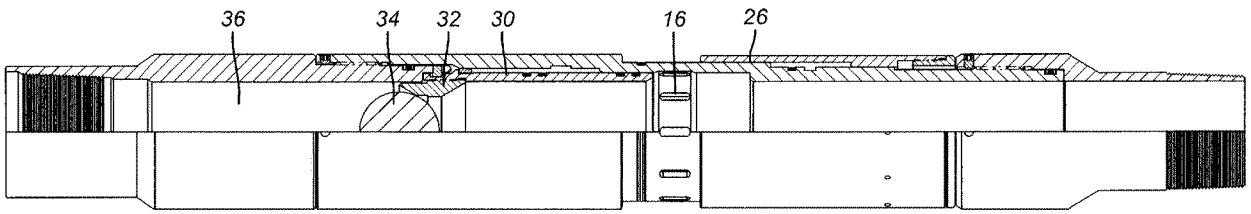
FIG. 2 is the view of FIG. 1 with the exterior sleeve shifted with internal pressure to open the ports
Figure 3:
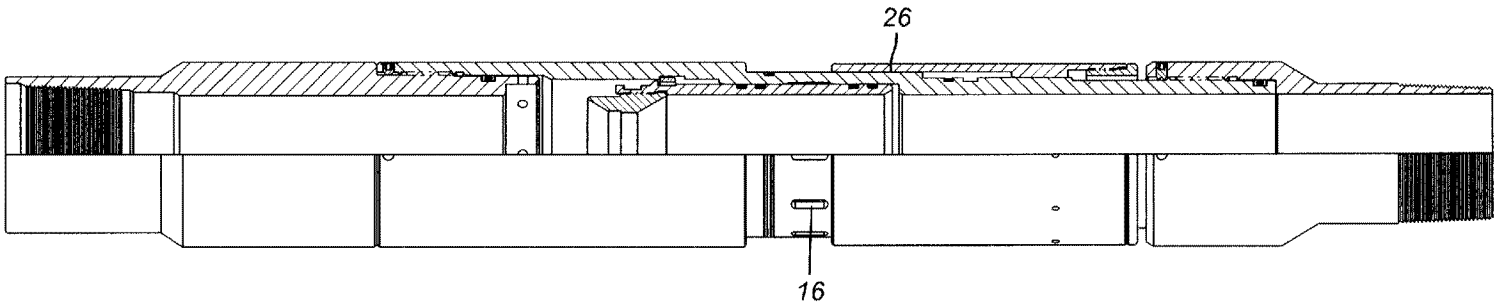
FIG. 3 is the view of FIG. 2 with a ball landed on a seat in an inside sleeve to push the inside sleeve down with pressure to close the ports.

Referring to FIG. 1 a mandrel 10 has end connections 12 and 14 to connect to a string that can have other similar mandrels such as 10. An array of ports 16 are shown closed by an outer sliding sleeve 18 that is optionally held in place by a breakable member such as a shear pin 20. Travel stop 22 defines the limit of travel of sliding sleeve 18. The force to shift sleeve 18 in the direction of arrow 24 is preferably applied pressure in the tubing acting on opposed piston areas of unequal size to produce the needed net force to move sleeve 18 from the FIG. 1 to the FIG. 2 position. When there are multiple mandrels 10 each with an external sleeve 18 the shear members 20 are designed to break at progressively higher force so that the sequence of movements of sleeves 18 can be in a desired order such as bottom up or top down as some examples. Inner sleeve 30 when used with external sleeve 18 is initially situated above the ports 16 and features a ball seat 32 to accept a ball 34 to block the passage 36 so that when pressure is built up on seated ball 34 the ball 34 moves in tandem with inner sleeve 30 to close the ports 16. While the seat 32 is shown at an upper end of inner sleeve 30 it can be located elsewhere on that same sleeve 30. The seats can be progressively larger in an uphole direction to allow sequential landing of different sized balls 34 in a bottom up direction for closing sleeves 30. In the ports 16 closed position of FIG. 3 there are spaced seals on the outside of sleeve 30 that span the ports 16. When all the ports 16 on all the mandrels 10 are closed the string to which they are connected can be pressurized to either set other tools or to pressure test the string itself In cementing service, as mentioned above, although wiper plugs can follow the cement there can still be residual remnants of cement on the equipment in the path of the cement going out openings 16. In the past when sleeves such as 30 were attempted to be closed with landing a plug in the sleeve and latching it to a profile the problem that arose was that the profiled was partly or fully fouled with cement particles. In this case the plug either passed through or if it latched did not latch properly allowing pressure bypass inhibiting the tool to build sufficient differential pressure long enough to get the sleeve to move across the open ports such as 16 to close them. On the other hand with a ball 34 sized for a seat 32 and structurally strong enough not to extrude through seat 32 under differential pressure during sleeve closing, the uncertainty of the past design is overcome in that sleeve 30 will move with pressure on seated ball 34 even if ball 34 does not seal perfectly on seat 32 due to the presence of residual cement. Some leakage past seat 32 is tolerated as long as a sufficient closing force is applied to the sleeve 30 to close the associated ports 16.

An even simpler design is envisioned using only sleeve 30 without external sleeve 18. In that case the ports 16 are initially in the closed position covered by sleeve 30. The sleeve 30 still has a seat 32 that accepts a ball 34 as before. However, the difference is that sleeve 30 is initially moved uphole in a direction opposite arrow 24 for the opening of ports 16. This can happen with pressure in passage 36 acting on opposed and unequal piston areas on sleeve 30 so that a new uphole force on sleeve 30 results from pressure in passage 36 so that movement in the direction opposite arrow 24 opens the ports 16 for cementing. After the cementing a ball 34 is landed on seat 32 and pressure from above on seated ball 34 will move the sleeve 30 in the direction of arrow 24 to close the ports 16. Those skilled in the art will appreciate that if only sleeves 30 are used without external sleeves 18, it will be sleeves 30 that are retrained with breakable members such as 20 that would span between the mandrel 10 and the sleeve 30 so that the sleeves 30 will open in a desired order at different pressure levels. Once a given sleeve 30 is opened for cementing it is reclosed using ball 34 on seat 32 such that it is isolated from passage 36 when passage 36 is later pressurized uphole to open the next sleeve uphole with pressure in passage 36.

Those skilled in the art will appreciate that either using a single sleeve per mandrel openings that is shifted twice, uphole with tubing pressure and downhole pressure on a ball on a seat in the sleeve, or if two sleeves are used that each make a single movement for opening, and closing the ports, the result is a reliable design that closes the ports even in the presence of cement remnants that preclude a perfect seal of the ball on the seat. While balls are preferred other objects that block the passage 36 are also envisioned. The balls can be milled out after the entire interval is cemented or otherwise treated. The balls can be made of a material that disintegrates or otherwise fails with time or exposure to well fluids, if desired. The sleeves once shifted to open the ports 16 can be held in place with a detent such as a c-ring whose retention force can be overcome such as when the design uses only a single sleeve internally that moves in opposed directions. The system offers the ability to sequentially open and close ports in different mandrels to facilitate a treatment such as cement for example.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A treatment apparatus for borehole use, comprising:

at least one mandrel having a passage therethrough and a plurality of wall ports selectively opened and closed by a valve assembly on said mandrel, at least a portion of said valve assembly moveable responsive to applied pressure thereon which creates a net force on said valve assembly to open said wall ports and at least a portion of said valve assembly further comprising a seat to accept an object for obstruction of said passage and tandem movement of said object and said valve assembly for closing said ports;

the valve assembly comprising a first sleeve external to the mandrel which is shifted with respect to the mandrel to open the wall ports; and a second sleeve within said passage; which is shifted with respect to the mandrel to close the wall ports.

2. The apparatus of claim 1, wherein:

said second sleeve comprising said seat.

3. The apparatus of claim 1, wherein:

said first sleeve releasably secured to said mandrel with a breakable member.

4. The apparatus of claim 3, wherein:

said first sleeve retained by a detent after movement that opens said ports.

5. A treatment apparatus for borehole use, comprising:

at least one mandrel having a passage therethrough and a plurality of wall ports selectively opened and closed by a valve assembly on said mandrel, at least a portion of said valve assembly moveable responsive to applied pressure thereon which creates a net force on said valve assembly to open said wall ports and at least a portion of said valve assembly further comprising a seat to accept an object for obstruction of said passage and tandem movement of said object and said valve assembly for closing said ports;

the valve assembly comprises a single sleeve located within the passage and moved in a first direction to open the ports via pressure in the passage acting on opposed and unequal piston areas on the single sleeve; and the single sleeve being moved in an opposite direction to close the ports with said object on the seat.

6. The apparatus of claim 5, wherein:

said single sleeve releasably secured to said mandrel with a breakable member.

7. The apparatus of claim 6, wherein:

said single sleeve retained by a detent after movement that opens said ports.

8. A borehole treatment method, comprising:

moving at least one sleeve of a valve assembly to open a plurality of wall ports extending from a passage in at least one mandrel with applied pressure within or outside of said mandrel, the at least one sleeve being moved with pressure in said passage acting on opposed and unequal piston areas;

performing a treatment through said open ports;

closing said ports by moving the at least one sleeve in response to pressure in a passage through said mandrel with tandem movement of an object landed on a seat in said passage on said valve assembly.

9. The method of claim 8, comprising:

providing a single sleeve in said passage as said at least one sleeve;

moving said single sleeve in opposed directions with pressure in said passage when opening and closing said plurality of wall ports.

10. The method of claim 9, comprising:

providing opposed end areas on said single sleeve for moving said single sleeve to open said plurality of wall ports with pressure in said passage without said object on said seat.

11. The method of claim 9, comprising:

providing a plurality of mandrels as said at least one mandrel;

releasably securing said single sleeve in said mandrels for release at different pressures for sequential operation of said single sleeves in said mandrels.

12. The method of claim 9, comprising:

providing a plurality of connected mandrels as said at least one mandrel;

sequentially opening said single sleeves on said mandrels with breakable members that release said single sleeves at different pressures applied in said passages extending through said connected mandrels;

cementing through said plurality of wall ports of said mandrels as said treatment.

13. The method of claim 8, comprising:

providing an external sleeve on said at least one mandrel and an internal sleeve in said passage as said valve assembly;

opening said plurality of ports with pressure external to said passage applied to said external sleeve;

closing said plurality of ports with passage pressure applied to said internal sleeve with said object on said seat of said internal sleeve.

14. The method of claim 13, comprising:

providing a plurality of connected mandrels as said least one mandrel;

sequentially opening said external sleeves on said mandrels with breakable members that release said external sleeves at different pressures applied in the passages of said mandrels;

cementing through said plurality of wall ports of said mandrels as said treatment.

* * * * *